United States Patent [19]

Cantor

[11] 3,936,923

[45] Feb. 10, 1976

[54] APPARATUS AND METHOD FOR INSTALLING A SLIDE FASTENER

[75] Inventor: Charles E. Cantor, Englewood, N.J.

[73] Assignee: Textron Inc., Providence, R.I.

[22] Filed: Nov. 5, 1974

[21] Appl. No.: 521,112

[52] U.S. Cl. ..... 29/408; 29/200 P; 29/559; 156/66; 156/73.1; 156/556; 156/583; 269/54.5

[51] Int. Cl.² ..... B29D 5/00

[58] Field of Search ..... 29/200 P, 207.5 R, 33.2, 29/559, 408; 269/54.5, 54, 54.1; 156/66, 73.1, 538, 556, 583

[56] References Cited

UNITED STATES PATENTS

| | | | |
|---|---|---|---|
| 1,750,463 | 3/1930 | Deinstein | 269/54.5 |
| 1,806,887 | 5/1931 | Bruno | 269/54.5 |
| 1,949,262 | 2/1934 | Stromelly | 269/54.5 |
| 2,674,559 | 4/1954 | Zobel | 156/66 |
| 2,680,087 | 6/1954 | Sundback | 29/408 X |
| 2,701,222 | 2/1955 | Hetzel et al. | 29/408 X |
| 3,345,226 | 10/1967 | Frenkel et al. | 156/66 |
| 3,883,931 | 5/1975 | Peterson | 24/205.11 R |

*Primary Examiner*—Victor A. DiPalma

[57] ABSTRACT

Apparatus and method for installing a slide fastener with or without a slider and pull assembly to material wherein specially arranged and spaced pairs of pins pierce the adjacent edges of the carrier tapes of the slide fastener prior to the slide fastener being bonded to material.

19 Claims, 5 Drawing Figures

FIG. 4
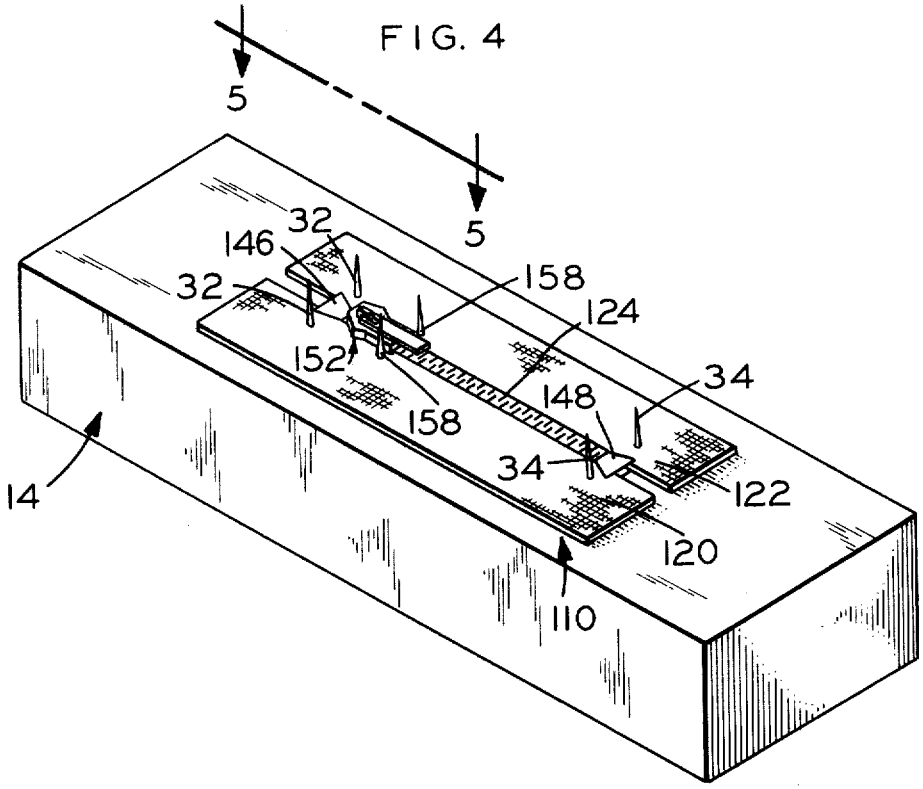
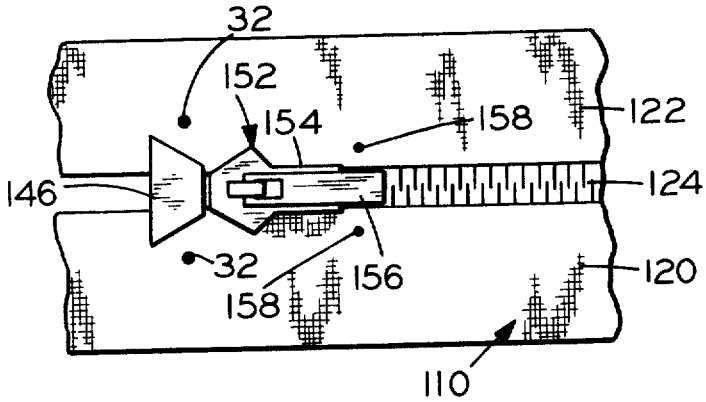
FIG. 5

APPARATUS AND METHOD FOR INSTALLING A SLIDE FASTENER

BACKGROUND OF THE INVENTION

1. Field of the Invention

This invention relates to a slide fastener and in particular to the apparatus and method for installing a slide fastener to material.

2. Description of the Prior Art

It has been the practice to install a slide fastener to material when the slide fastener has carrier tapes composed of natural or synthetic material, wherein each one of the interengaged filaments of the slide fastener is secured to its respective one of the adjacent edges of the carrier tapes and wherein the adjacent edges of material are emplaced on and bonded in some fashion to the adjacent edges of the carrier tapes of the slide fastener.

U.S. Pat. Nos. 2,674,559 and 2,984,287 are representative of the prior art and illustrate a variety of apparatus and methods for installing a slide fastener or elements thereof to material.

One of the problems associated with the prior art apparatus and method for installing a slide fastener to material is that the prior apparatus in installing a slide fastener to material often resulted in the installed slide fastener having an arcuate contour instead of a flat appearance throughout its extent whereby the arcuately contoured slide fastener as installed in material would detract from or otherwise limit the appearance or fashion design of the material.

SUMMARY OF THE INVENTION

The present invention is summarized in an apparatus and method for installing a slide fastener to material, the slide fastener having a pair of carrier tapes and opposed interengaged fastening elements with each one of the elements being secured to its respective one of the adjacent edges of the pair of carrier tapes, wherein the apparatus includes a support block means, a first pair of laterally spaced pins disposed at one end of said block means, a second pair of laterally spaced pins disposed at the opposed end of said block means and spaced at a longitudinal distance less than the length of the slide fastener from said first pair of pins, each pin of said first or second pair being laterally spaced relative to the other pin of its respective pair at a distance greater than the overall width of the interengaged filaments of the slide fastener, the first and second pairs pins adapted for piercing certain opposed and spaced end portions of the adjacent edges of the carrier tapes of the slide fastener with the first and second pairs of pins so as to effect securing of the slide fastener to said first and second pairs of pins while at the same time to effect substantially flat nesting engagement of the secured slide fastener on said block means prior to attachment of the material to the slide fastener.

An object of the present invention is to provide an apparatus having at least two pairs of spaced pins for piercing the adjacent edges of carrier tapes of a slide fastener without adversely affecting the appearance of the slide fastener itself or the material to which it is installed.

Another object of the present invention is to provide an apparatus having spaced pairs of pins for securing a slide fastener with or without a slider and pull assembly to a support block.

This invention has another object in that the apparatus in having spaced pairs of pins secures the slide fastener with or without a slider and pull assembly in substantially flat nesting engagement on a support block prior to and during installation of the slide fastener to material.

Other objects and advantages of the present invention will become more apparent from the following description taken in conjunction with the accompanying drawings.

BRIEF DESCRIPTION OF THE DRAWINGS

FIG. 4 is a perspective view of another embodiment of the present invention with parts added and other parts broken away; and FIG. 5 is an enlarged plan view with parts broken away as taken along line 5—5 of FIG. 4 and illustrates further details of the present invention.

DESCRIPTION OF THE PREFERRED EMBODIMENTS

Figure 1:
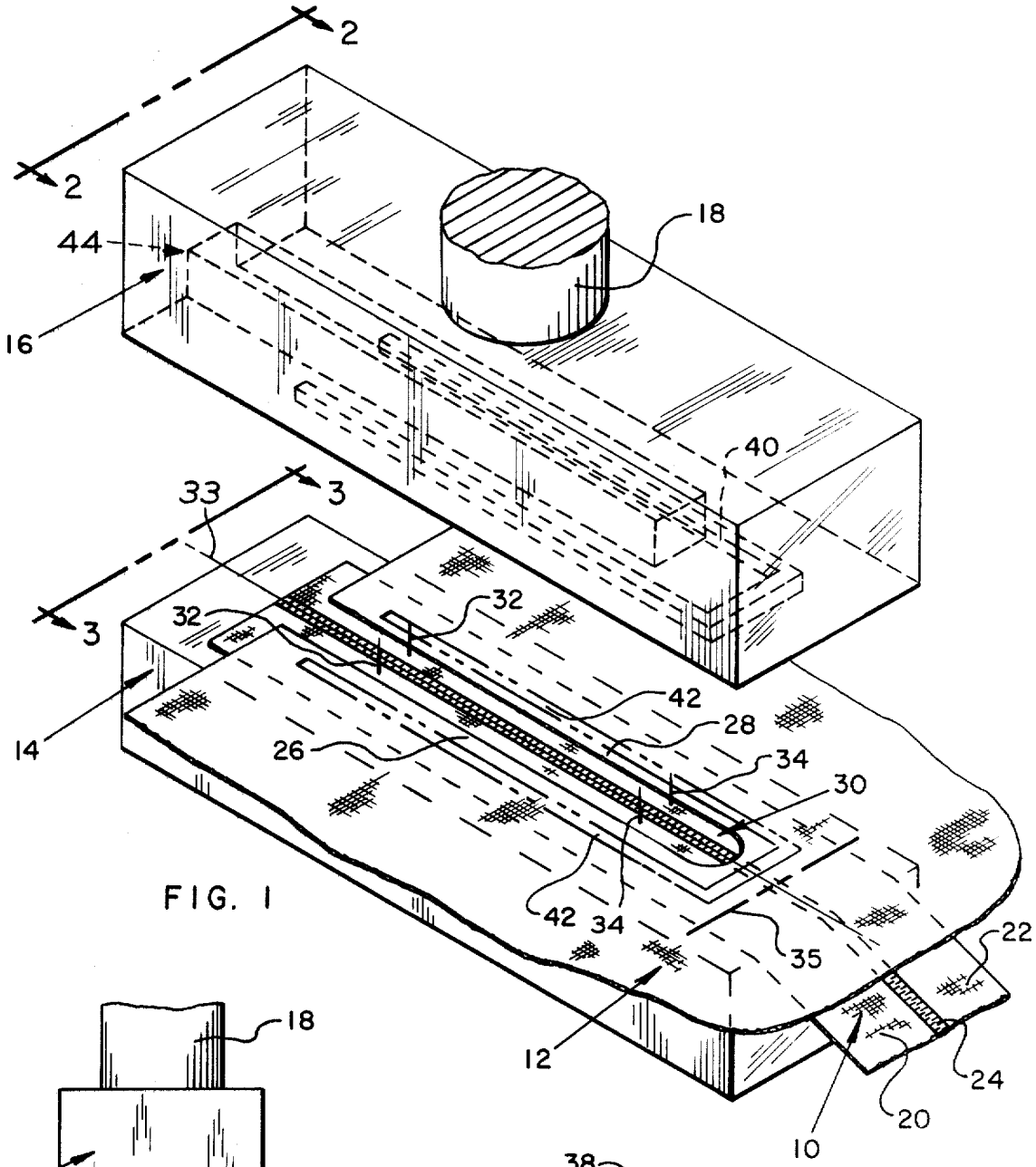
FIG. 1 is a perspective view with parts broken away and other parts shown in dotted and solid lines of an apparatus for installing a slide fastener chain to garment material and embodying the present invention.

The present invention is embodied in an apparatus and method for installing a slide fastener chain 10 to garment material 12 as illustrated in FIG. 1. The apparatus includes a block 14 for supporting slide fastener chain 10 and for effecting emplacement of garment material 12 in overlapping relation to slide fastener chain 10. The apparatus also includes a die element 16 disposed above and in alignment with the top of block 14. During operation of the apparatus, die element 16 by way of its actuating ram 18 is advanceable between raised and lowered positions relative to the top of block 14 for effecting bonding and installation of the slide fastener chain 10 to the emplaced garment material 12.

Slide fastener chain 10 is made up of a pair of carrier tapes 20, 22 and opposed interengaged fastening elements or filaments 24 with each one of the opposed filaments 24 being secured to the adjacent edge of its respective carrier tape 20 or 22. Each one of the carrier tapes 20, 22 are composed of a natural or synthetic material, for example, a cotton fabric or plastic material such as a nylon or polyester. Carrier tapes 20, 22 are preferably of woven construction so as to enhance the elasticity and stretchability of slide fastener chain 10. Opposed elements or filaments 24 are composed of a natural or synthetic material such as a suitable grade of steel or plastic, for instance, nylon.

Garment material 12 has spaced adjacent edges 26, 28 that define a common opening 30 to be closed by slide fastener chain 10. Garment material 12 is made up of an appropriate natural or synthetic material and is normally of a woven thread construction.

The top of support block 14 has a first pair of upstanding pins 32, 32 at one end and a second pair of upstanding pins 34, 34 at its opposite end. The second pair of pins 34, 34 are spaced at a longitudinal distance from and are disposed substantially in longitudinal alignment relative to the first pair of pins 32, 32. Each one of the pins 32 or 34 of either pair is suitably affixed at its lower end to the top of the block 14. A pin 32 or 34 is of relatively thin size in cross section and preferably has a sewing needle configuration with the upper end of a pin 32 or 34 having a pointed end. Each one of the pins of the first or second pair 32 or 34 is laterally spaced relative to the other pin of its respective pair at a lateral distance greater than the overall width of the interengaged filaments 24 as viewed in FIG. 1. The lateral distance between the first pair of pins 32, 32 is indicated by arrowed line 36 in FIG. 3. Each pair of pins 32, 32 or 34, 34 in being laterally spaced lie in a common transverse plane at their respective end of block 14 wherein the common transverse plane for each pair of pins 32, 32 and 34, 34 is usually disposed parallel to and spaced from an end face of block 14. First and second pairs of pins 32, 32 and 34, 34; respectively, are preferably disposed in symmetrical relation about the longitudinal axis 33 of the interengaging elements 24 of slide fastener chain 10, as depicted in FIG. 1.

A length of slide fastener chain 10 is suitably fed between block 14 and die element 16 until the leading end of the fed slide fastener chain 10 is disposed beyond the first pair of pins 32 in the manner illustrated in FIG. 1. The fed length of slide fastener chain 10 is disposed above and in vertical alignment relative to the first and second pairs of pins 32, 32 and 34, 34 such that the opposed interengaged filaments 24 of the fed length of slide fastener chain 10 are interposed between and spaced above the first and second pairs of pins 32, 32 and 34, 34.

The leading and trailing ends of the fed length of the slide fastener chain 10 disposed above the first and second pairs of pins 32, 32 and 34, 34 may be suitably grasped, such as by the hands of the operator, so as to effect tensioning of the fed length of slide fastener chain 10 between its ends. It has been found that stretching of the fed length of slide fastener chain 10 between its leading and trailing ends on the order of one-eighth of an inch per length of the slide fastener chain 10 has been satisfactory to properly tension the slide fastener chain 10 between the first and second pairs of pins 32, 32 and 34, 34 before the tensioned and fed length of slide fastener chain 10 is pierced by and secured to the first and second pairs of pins 32, 32 and 34, 34.

Figure 3:
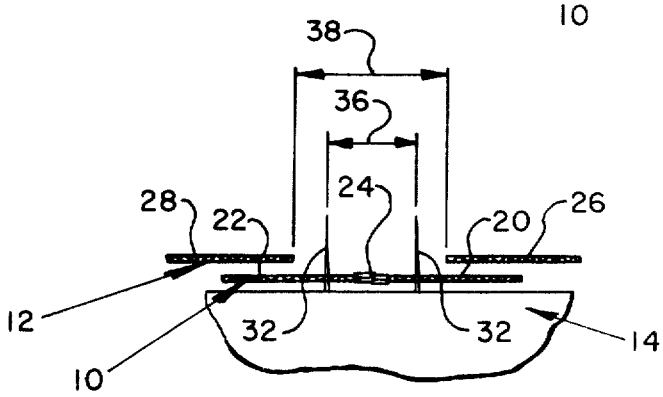
FIG. 3 is an enlarged and partial end elevational view with certain parts shown in slightly vertically spaced relation to each other and other parts broken away as taken along line 3—3 of FIG. 1 and illustrates further details of the apparatus of the present invention.

Certain spaced and opposed end portions of the adjacent edges of carrier tapes 20, 22 of the slide fastener chain 10 are pierced by the upper ends of the first and second pairs of pins 32, 32 and 34, 34 as the fed length of the slide fastener chain 10 is lowered in an appropriate manner from a position above the first and second pairs of pins 32, 32 to a lower position in engagement therewith as illustrated in FIGS. 1 and 3. The lower most position of slide fastener chain 10 occurs when the bottom of the slide fastener chain is disposed in substantially flat nesting engagement with the top of the block 14 thereby securing the slide fastener chain 10 to the first and second pairs of pins 32, 32 and 34, 34. Opposed interengaged filaments 24 of the secured slide fastener chain 10 are interposed between and spaced from the first and second pairs of pins 32, 32 and 34, 34.

Prior to emplacement of garment material 12 on the front of the secured slide fastener chain 10, the leading end of the non-secured length of slide fastener chain 10 may be severed from the trailing end of the secured slide fastener chain 10 by severing along a line of severance between the secured and non-secured lengths of the slide fastener chain 10 as indicated by the dashed line 35 in FIG. 1. The fed length of the secured slide fastener chain 10 has a greater distance between its ends than the longitudinal distance between the first and second pairs of pins 32, 32 and 34, 34.

Garment material 12 is emplaced on the front of slide fastener chain 10 on block 14 such that bottom surface portions of the adjacent edges 26, 28 of the emplaced garment material 12 are disposed in overlapping engagement with opposed and underlying front surface portions of the adjacent edges of the secured slide fastener chain 10 on block 14 as depicted in FIGS. 1 and 3. The first and second pairs of pins 32, 32 and 34, 34 are interposed between and spaced from the adjacent edges 26, 28 of the emplaced garment material 12 as illustrated in FIG. 1 and as further indicated by the difference in the space between arrowed lines 38 and 36 in FIG. 3. In emplacing garment material 12 on the secured slide fastener chain 10 the top edge of the garment material 12 at the forward end of opening 30 is disposed to the left of the first pair of pins 32, 32 as viewed in FIG. 1 and is also disposed in offset fashion to the leading end of the secured slide fastener chain 10 such that the leading end of the secured slide fastener chain 10 is partially exposed as shown in FIG. 1.

The bottom surface of die element 16 of the apparatus of the present invention has a protruding U-shaped rib 40 disposed thereon and extending between the opposed ends of die element 16. The U-shaped rib 40 is arranged to contact U-shaped strip surface portions 42 on the front surfaces of the adjacent edges 26, 28 of the emplaced garment material 12. The outer perimeter of the U-shaped strip surface portions 42 is indicated by dashed lines in FIG. 1 on the front surfaces of the adjacent edges 26, 28 of the emplaced garment material 12.

The U-shaped rib 40 has a length greater than the longitudinal distance between the first and second pairs of pins 32, 32 and 34, 34 on block 14. U-shaped rib 40 is located on die element 16 such that it contacts the adjacent edges 26, 28 of the emplaced garment material 12 in centered relation with respect to the first and second pairs of pins 32, 32 and 34, 34 when U-shaped rib 40 of die element 16 is lowered to engage the emplaced garment material 12.

A downwardly facing channel-shaped recess 44 is formed on the bottom surface of die element 16 and is interposed between and spaced from U-shaped rib 40 so as to be disposed in vertical alignment relative to the first and second pairs of pins 32, 32 and 34, 34 on block 14. The recess 44 has a length that is greater than the longitudinal distance between the first and second pairs of pins 32, 32 and 34, 34 and extends from the left end of die element 16 to adjacent the U-shaped end of rib 40. Moreover, recess 44 has a length, width and depth such that the first and second pairs of pins 32, 32 and 34, 34 will be freely received within recess 44 of die element 16 during operation of the described apparatus. As shown, the ribs 40, 40 may be the parallel arms of a U-shaped rib with a rib portion joining the parallel arms at the end. In the absence of the joining rib portion, recess 44 may extend to the ends of the die element 16.

When U-shaped rib 40 of die element 16 is lowered into pressured contact with the U-shaped strip surface portions 42 on the front surfaces of the adjacent edges 26, 28 of the emplaced garment material 12, opposed U-shaped bottom strip surface portions of the adjacent edges 26, 28 of the emplaced garment material 12 are pressed into bonding engagement with the opposed and underlying U-shaped front strip surface portions of the overlapped adjacent edges of the carrier tapes 20, 22 of the secured slide fastener chain 10. The slide fastener chain 10 and garment material 12 may be bonded together in various ways such as, for example, by appropriate heating or ultrasonic vibration of die element 16 when the U-shaped rib 40 of die element 16 is in pressured contact with garment material 12 as aforedescribed. Upon bonding the slide fastener chain 10 to garment material 12 die element 16 is elevated to its raised position and the adjacent edges of the carrier tapes 20, 22 of the slide fastener chain 10 are suitably disengaged by the operator from the first and second pairs of pins 32, 32 and 34, 34. Upon removal of garment material 12 with slide fastener chain 10 installed thereto from block 14 another length of slide fastener chain 10 is fed onto block 14 for installing the fed length of slide fastener chain to another piece of garment material 12 in accordance with the teachings of the present invention.

Figure 2:
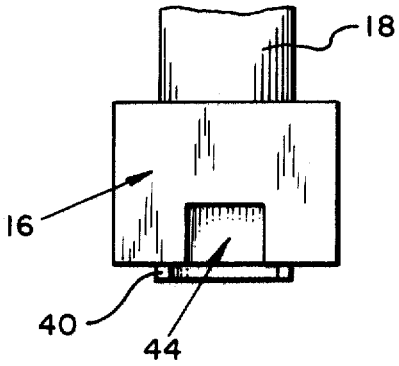
FIG. 2 is an end elevational view as taken along lines 2—2 of FIG. 1 and illustrates the upper die element for the apparatus.

In another embodiment of the present invention an apparatus as illustrated in FIGS. 4–5 installs a slide fastener 110 to material in similar fashion as the apparatus of FIGS. 1–3 installs slide fastener chain 10 to garment 12. Reference numerals in the apparatus of FIGS. 4–5 with like numbers as in the apparatus of FIG. 1–3 correspond to identical parts; and reference numerals in the apparatus of FIGS. 4–5 which refer to similar parts in the apparatus of FIGS. 1–3 have the same number with 100 added. For example, the slide fastener 110 is similar to the slide fastener chain 10.

Opposed ends of the slide fastener 110 include top and bottom stops 146 and 148. An appropriate design of a slider and pull assembly 152 is suitably connected to the opposed interengaged filaments 124 between the ends of the slide fastener 110 and is made up of a slider 154 and pull 156. Top and bottom stops 146 and 148 may have a width greater than the overall width of the slider and pull assembly 152 as shown in FIG. 5.

A third pair of laterally spaced pins 158, 158 are disposed on support block 14 and interposed between and spaced from said first and second pairs of pins 32, 32 and 34, 34. Further, the third pair of pins 158, 158 are longitudinally aligned relative to and between the first and second pairs of pins 32, 32 and 34, 34. The third pair of pins are disposed nearer the first pair of pins 32, 32 and are spaced at a longitudinal distance from the first pair of pins so as to center the slider and pull assembly 152 in spaced relation between the first and third pairs of pins in FIG. 5. One pin 32 of the first pair of pins is laterally spaced from its respective other pin 32 of the first pair at a lateral distance slightly greater than the maximum width of the top stop 146 as shown in FIG. 5. Further one pin 34 of the second pair of pins is laterally spaced from its respective other pin 34 of the second pair at a lateral distance slightly greater than the maximum width of the bottom stop 148. The lateral spacing between the third pair of pins 158, 158 relative to a slider and pull assembly, such as assembly 152 in FIGS. 4–5, will of course vary by reason of the large variety of types and sizes of slider and pull assemblies being used. The third pair of pins 158, 158 lie in a common plane transverse of block 14 which common plane is parallel to a plane transverse of block 14 and including the first pair of pins 32, 32. Each pin 158 of the third pair of pins corresponds in shape to each pin 32 or 34 of the first or second pair of pins.

Slide fastener 110 has a length somewhat greater than the longitudinal distance between the first and second pairs of pins 32, 32 and 34, 34. The slide fastener is fed onto block 14 in appropriate fashion above the first, second and third pairs of pins 32, 32; 34, 34; and 158, 158 such that the opposed interengaged filaments 124 of slide fastener 110 are interposed between and spaced from the first, second and third pairs of pins. At the same time the top and bottom stops 146 and 148 are interposed between and spaced from the first and second pairs of pins 32, 32 and 34, 34 respectively and the slider and pull assembly 152 is centered between and spaced from the first and third pairs of pins 32, 32 and 158, 158 as depicted in FIGS. 4–5.

Other opposed and spaced end portions of the carrier tapes 120 and 122 adjacent the inner edges thereof are pierced by the third pair of pins 158, 158 as the certain opposed and spaced end portions are pierced by the first and second pairs of pins 32, 32 and 34, 34 when the centered and fed slide fastener 110 is lowered in suitable manner from a raised position to a lowered poition as shown in FIG. 4. When the pin-pierced slide fastener is secured in substantially flat nesting engagement between the first, second and third pairs of pins 32, 32; 34, 34; and 158, 158 on top of block 14, the slider and pull assembly 152 is secured and retained between the first and third pairs of pins 32, 32 and 158, 158 as shown in FIGS. 4–5.

Upon securement of slider fastener 110 to the top of block 14, material such as garment 12 is placed on top of the slide fastener for effecting installation of the slide fastener to material 12 in similar fashion as in the apparatus of FIGS. 1–3. However, slide fastener 110 may be a slide fastener chain with a plurality of spaced and successively arranged slider and pull assemblies 152 attached thereto. Depending upon the material to which the slide fastener chain 10 or slide fastener 110 is to be installed opposed and spaced end portions of the material may be pierced by the first and second pairs of pins 32, 32 and 34, 34 or the first, second and third pairs of pins 32, 32; 34, 34; and 158, 158 before or after the slide fastener chain 10 or slide fastener 110 is pierced by the first and second pairs of pins or the first, second and third pairs of pins as aforedescribed. Because of different requirements for installing slide fastener 110 to material, slider 154 may be located at another point intermediate of stops 146 and 148; accordingly the third pair of pins 158, 158 would be located at another point adjacent a differently located slider 154 and closer to the second pair of pins 34, 34 other than the position of the slider and third pair of pins as shown in FIGS. 4–5.

The pins 32, 34 or 158 of the first, second or third pair will at most form very minute punctures or holes in the adjacent edges of the pair of carrier tapes 20, 22 or 120, 122 of slide fastener chain 10 or slide fastener 110. The minute punctures in the adjacent edges of the carrier tapes 20, 22 or 120, 122 will not detract from the appearance of the material to which slide fastener chain 10 or slide fastener 110 is installed. Although slide fastener 110 has bridge-type stops 146, 148 as illustrated in FIGS. 4–5, the slide fastener may use other types of stops in carrying out the present invention. Because a fed length of slide fastener chain 10 or slide fastener 110 may be readily centered with respect to the first and second pairs of pins 32, 32 and 34, 34 or the first, second and third pairs of pins 32, 32; 34, 34; and 158, 158 the slide fastener chain 10 or slide fastener 110 may be installed to material without requiring a great deal of skill by the operator of the apparatus of the present invention.

Since the present invention is subject to many modifications, variations and changes in detail, it is intended that all matter contained in the foregoing description or shown in the accompanying drawing shall be interpreted as illustrated and not in a limiting sense.

What is claimed is:

1. An apparatus for installing a slide fastener to material, the slide fastener having a pair of carrier tapes and opposed interengaged fastening elements with each one of the elements being secured to its respective one of the adjacent edges of the pair of carriage tapes, said apparatus comprising a support block means, a first pair of laterally spaced pins disposed at one end of said block means, a second pair of laterally spaced pins disposed at the opposed end of said block means and spaced at a longitudinal distance less than the length of the slide fastener from said first pair of pins, each pin of said first or second pair being laterally spaced relative to the other pin of its respective pair at a distance greater than the overall width of the interengaged elements of the slide fastener, and said first and second pairs of pins adapted for piercing certain opposed and spaced end portions of the adjacent edges of the carrier tapes of the slide fastener so as to effect securing of the slide fastener to said first and second pairs of pins while at the same time to effect substantially flat nesting engagement of the secured slide fastener on said block means prior to attachment of the material to the slide fastener.

2. An apparatus as set forth in claim 1 wherein the material has adjacent edges defining an opening therebetween and there is included die means arranged to engage spaced front surface portions of the adjacent edges of the material so as to effect bonding between the underlying opposed surface portions of the adjacent edges of both the material and the carrier tapes of the secured slide fastener.

3. An apparatus as set forth in claim 1 wherein each one of said pins of said first and second pairs are of relatively thin cross-section and of sewing needle configuration.

4. An apparatus as set forth in claim 2 wherein said die means has rib means for contacting certain surface portions of the adjacent edges of the material so as to effect bonding of the material to the slide fastener.

5. An apparatus as set forth in claim 1 wherein die means are arranged in operative relationship to said first and second pairs of pins, and wherein said die means has a recess for freely receiving said first and second pairs of pins.

6. An apparatus as set forth in claim 1 wherein a third pair of laterally spaced pins are mounted on said support block means and interposed between and spaced from said first and second pairs of pins.

7. An apparatus as set forth in claim 6 wherein the slide fastener includes a slider and pull assembly, and wherein said third pair of pins are in spaced relation between the first and second pairs of pins so as to center the slider and pull assembly relative to the longitudinal axis of the interengaged elements of said slide fastener.

8. An apparatus as set forth in claim 6 wherein the slide fastener includes a top stop; and said first pair of pins has a lateral spacing therebetween that is slightly greater than the maximum width of the top stop.

9. An apparatus as set forth in claim 6 wherein the slide fastener includes a bottom stop; and said second pair of pins has a lateral spacing therebetween that is slightly greater than the maximum width of the bottom stop.

10. An apparatus as set forth in claim 6 wherein each one of said third pair of pins are of relatively thin cross section and of sewing needle configuration.

11. A method of installing a slide fastener to material, the slide fastener having a pair of carrier tapes with adjacent edges and opposed interengaged elements each each one of the elements being secured to its respective adjacent edge of the carrier tapes, the method utilizing a slide fastener support block means, first and second pairs of spaced pins for engaging the slide fastener, the first and second pairs of pins disposed at opposite ends of said block means and spaced at a longitudinal distance from each other, said method comprising the steps of feeding a slide fastener having a length greater than the longitudinal distance between said first and second pairs of pins, centering the fed length of slide fastener relative to the first and second pairs of pins such that the opposed interengaged filaments of the slide fastener are interposed between and spaced from the first and second pairs of pins, piercing certain opposed and spaced end portions of the adjacent edges of the carrier tapes of the fed and centered slide fastener with the first and second pairs of pins so as to effect securing of the slide fastener to the first and second pairs of pins while at the same time to effect substantially flat nesting engagement of the secured slide fastener on said block means prior to securing of the material to the slide fastener, and securing the slide fastener to the material.

12. The method as set forth in claim 11 wherein the material is garment material with spaced adjacent edges defining an opening therebetween, and wherein there is included an additional step of emplacing the adjacent edges of garment material in overlapping engagement with the front of the adjacent edges of the carrier tapes of the secured slide fastener and with the adjacent edges of the emplaced garment material being spaced from the first and second pairs of pins.

13. The method as set forth in claim 12 wherein the securing step includes bonding the adjacent edges of the emplaced garment material to the overlappingly engaged adjacent edges of the carrier tapes of the secured slide fastener.

14. The method as set forth in claim 11 wherein an additional step includes stretching the slide fastener between its ends on the order of one-eighth of an inch per length of the slide fastener between its ends prior to piercing certain opposed and spaced end portions of the adjacent edges of the carrier tapes of the slide fastener with the first and second pairs of pins.

15. The method as set forth in claim 11 wherein the slide fastener has a slider and pull assembly attached thereto, and wherein a third pair of spaced pins are disposed on said block means and are interposed between and spaced from said first and second pairs of pins.

16. The method as set forth in claim 15, wherein the slide fastener has a top stop; and one of the pins of the first pair of pins is laterally spaced from its associated pin of the first pair at a distance somewhat greater than the maximum width of the top stop.

17. The method as set forth in claim 15, wherein the slide fastener has a bottom stop; and one of the pins of the second pair of pins is laterally spaced from its associated pin of the second pair at a distance somewhat greater than the maximum width of the bottom stop.

18. The method as set forth in claim 15 wherein an additional step includes centering the slider and pull assembly between said third pair of pins as the fed length of slide fastener is centered relative to the first and second pairs of pins.

19. The method as set forth in claim 15 wherein the step of piercing certain opposed and spaced end portions of the adjacent edges of the carrier tapes of the fed and centered slide fastener with the first and second pairs of pins also includes piercing other opposed and spaced end portions of the adjacent edges of the carrier tapes with the third pair of pins so as to effect securing of the slider and pull assembly relative to the longitudinal axis of the interengaged filaments of said slide fastener and in spaced relationship to said first and third pairs of pins upon securing said slide fastener between said first, second and third pairs of pins and in substantially flat nesting engagement with said block means.

* * * * *